United States Patent [19]

Porter

[11] 3,961,387

[45] June 8, 1976

[54] TRIG MAKING TOOLS

[76] Inventor: Gail E. Porter, 4750 182nd Place, Country Club Hills, Ill. 60477

[22] Filed: Nov. 22, 1974

[21] Appl. No.: 526,144

[52] U.S. Cl. ..... 7/5.6; 72/409

[51] Int. Cl.[2] ..... B25F 1/00

[58] Field of Search ..... 72/409, 410, 379, 470, 72/460; 7/14.1, 5.4, 5.6; 140/106

[56] References Cited

UNITED STATES PATENTS

| | | | |
|---|---|---|---|
| 1,842,678 | 1/1932 | Kreuzeder | 72/409 |
| 3,357,460 | 12/1967 | Gawura | 140/106 |
| 3,525,107 | 8/1970 | Hays | 7/5.3 |

*Primary Examiner*—Al Lawrence Smith
*Assistant Examiner*—Roscoe V. Parker
*Attorney, Agent, or Firm*—S. J. Lehrer; William F. Frank

[57] ABSTRACT

A plier-type tool for producing guide-line clips — known as trigs — as needed on bricklaying jobs. The tool receives the trig-material strip from the side, and its jaws are formed to properly set the leading portion of the strip in the tool, to indent such portion to fluted form on the closing of the jaws, and to accurately guide the remaining strip portion for bending it together with the leading portion.

9 Claims, 5 Drawing Figures

TRIG MAKING TOOLS

This invention relates to accessories for laying bricks, and more particularly to the clips — known as trigs — used by bricklayers to hold fast the guide lines used in laying bricks.

One object of the invention is to make use — on the job — of the metal bands that hold bricks together when delivered instead of discarding them as waste, and make the trigs from the band material for handy use as the rows of bricks are laid.

A further object is to provide a tool in the nature of a pair of pliers, but specially designed to produce trigs by hand quickly and with little effort.

Another object is to construct a trig making tool on the principle of a hand-press which receives the proper length from the band strip, forms the line retainer, and allows the trig to be completed by simple manual pressure.

An important object is to design the tool with a minimum of parts and sufficiently sturdy for rough handling.

A better understanding of the invention may be gained by reference to the accompanying drawing, in which.

Figure 1:
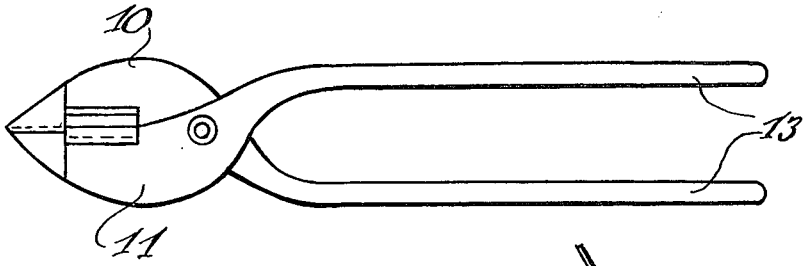
FIG. 1 is a side view of the tool on a reduced scale.

Referring specifically to the drawing, 10 and 11 denote the similarly-formed jaws at the head of the tool, the jaws being joined by a rivet 12 and continuing with handles 13 formed and operable like a pair of pliers.

Figure 2:
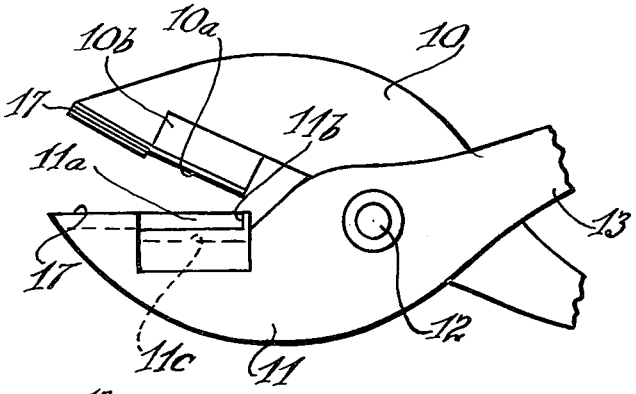
FIG. 2 is a similar view of the head-portion of the tool full-size and partly open.
Figure 3:
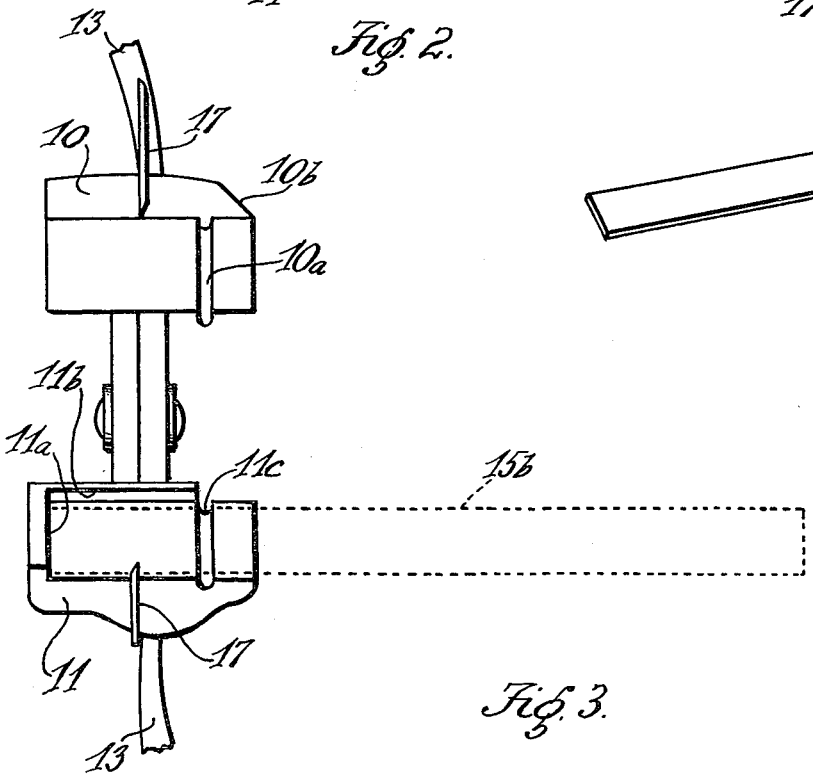
FIG. 3 is a front-end view of the tool wide open.

The band strip 15 is inserted with a leading end into the tool when its jaws are separated as in FIG. 2. FIG. 3 shows the lower jaw 11 made flat with an end-wall 11*a* and a side wall 11*b*, these walls forming stops to limit and properly set the leading end of the band strip in the tool, as indicated by finely-dotted lines in FIG. 3.

Figure 4:
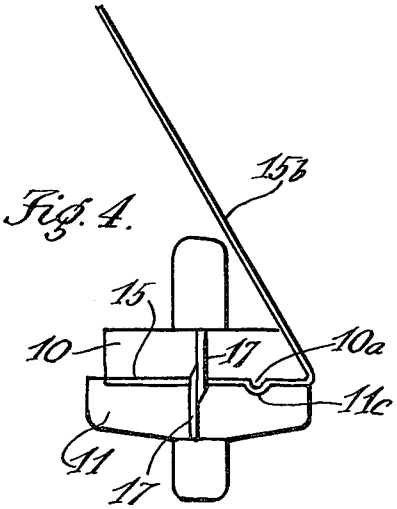
FIG. 4 is a similar view of the tool closed on a trig being formed.
Figure 5:
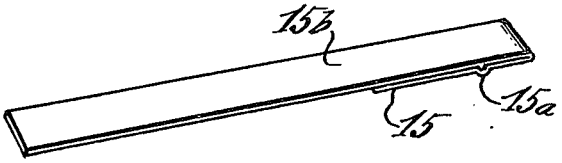
FIG. 5 is a perspective view of the trig in completed form.

As seen in FIG. 5, the trig has a fluted line retainer 15a on the under side. This transverse groove is formed when the strip — deposited as described — receives a pressing indentation on the closing of the upper jaw 10 as the handles are gathered. The indentation is made by a rib 10*a* formed on the under side of the upper jaw in matching relation to a groove 11*c* formed in the surface of the lower jaw. The position and form of the inner strip portion are apparent in FIG. 4, while the longer portion of the strip extends sidewise according to the finely-dotted lines in FIG. 3.

The upper jaw 10 is formed with a side bevel 10*b* which forms a limit and guide to bend the strip back by hand while it is still clamped in the tool to the position shown in FIG. 4. The strip may now be removed by opening the jaws of the tool, and the longer portion 15*b* cut apart from the band. The tool may be used for this purpose, since its jaws are extended with shear cutters 17 used as in cutting pliers. The trig is completed by pressing it together between the upper and lower jaws of the trig tool, so that the finished trig appears as in FIG. 5.

It is now apparent that the novel tool incorporates the precision and power of machine dies in a simple hand tool operable like a pair of pliers. The lower jaw furnishes a base, and end-limit and a side-limit for depositing the end-portion of the strip 15 securely and accurately without special attention or adjustment before the strip is impressed. Thus, strips are not only pressed as in a machine, but are always identical with each other and therefore uniform. The length of the shorter, pressed portion is also made accurate by providing the side bevel 10b as a fixed bending point for each strip; and the partial bend is to a point where it is easy to press the sections of the trig together between the jaws of the tool. Also, the bevel 10*b* is obviously designed accurately crosswise, so that the sections of the strip meet in line when pressed together. It is thus apparent that the present tool is a handy accessory to produce trigs as required, both accurately and at no cost.

I claim:

1. A plier-type tool to make clips from a metal strip and having a pair of similarly-formed jaws, the lower jaw serving as a flat base with a recess for receiving said strip from the side, said recess having an end-wall as a limit to the length of insertion of said strip and a side wall as a guide during such insertion, said walls combining to fix the location of the strip in the recess in said base, the lower jaw further containing an indentation in the bottom surface of said recess, the upper jaw being formed flat with a projection matching the indentation to impress the strip when the jaws are closed, said upper jaw further having a beveled surface on one side thereof to define the outer limit of the inserted portion of said strip for bending the remaining portion of said strip back upon said inserted portion after said strip has been impressed.

2. The structure of claim 1, and shearing cutters extended from the jaws for severing the strip as required.

3. A plier-type tool comprising a pair of jaws, one jaw serving as a base for receiving the leading portion of a strip from the side, said jaw including means to set the location of said leading portion and further containing an indentation, the other jaw being formed with a projection matching the indentation to impress the strip when the jaws are closed, said other jaw further having means forming an outer limit for said leading portion for bending the remaining portion about it comprising a bevel on one side of said other jaw against which to perform said bending.

4. The structure of claim 3, the indentation being a transverse groove and the projection a rib, and the strip becoming fluted when impressed.

5. The structure of claim 3, said base having an end-wall as a limit to the insertion of the strip from the side.

6. The structure of claim 3, said base having a side wall as a guide for the insertion of the strip from the side.

7. The structure of claim 3, said base having an end-wall as a limit to the insertion of the strip and a side wall as a guide during such insertion, and said walls combining to fix the location of the strip on the base.

8. The structure of claim 3, the bevel being at an angle sufficiently sharp to permit the pressing of the bend to close the remaining strip portion into doubled relation with said leading portion.

9. The structure of claim 3 further including shearing cutters extended from the jaws for severing the strip as required.

* * * * *